US005712050A

United States Patent [19]

Goldman et al.

[11] Patent Number: 5,712,050

[45] Date of Patent: Jan. 27, 1998

[54] SUPERALLOY COMPONENT WITH DISPERSION-CONTAINING PROTECTIVE COATING

[75] Inventors: Edward Harvey Goldman, Cincinnati; Ramgopal Darolia, West Chester; David John Wortman, Hamilton, all of Ohio

[73] Assignee: General Electric Company, Cincinnati, Ohio

[21] Appl. No.: 411,919

[22] Filed: Mar. 28, 1995

Related U.S. Application Data

[63] Continuation of Ser. No. 185,775, Jan. 24, 1994, which is a continuation of Ser. No. 956,515, Oct. 5, 1992, which is a continuation-in-part of Ser. No. 756,947, Sep. 9, 1991, abandoned.

[51] Int. Cl.[6] ..... B32B 15/04

[52] U.S. Cl. ..... 428/680; 428/678; 428/614; 416/241 R

[58] Field of Search ..... 428/614, 678, 428/680, 937; 416/241 R

[56] References Cited

U.S. PATENT DOCUMENTS

| | | | |
|---|---|---|---|
| 3,776,704 | 12/1973 | Benjamin | 75/951 |
| 3,864,093 | 2/1975 | Woljla | 428/926 |
| 4,029,477 | 6/1977 | Grisik | 428/680 |
| 4,101,713 | 7/1978 | Hirsch et al. | 428/678 |
| 4,111,685 | 9/1978 | Baranow | 75/951 |
| 4,169,742 | 10/1979 | Wukusick et al. | 420/445 |
| 4,198,442 | 4/1980 | Gupta et al. | 428/678 |
| 4,230,748 | 10/1980 | Patel | 427/423 |
| 4,237,193 | 12/1980 | Jackson et al. | 428/679 |
| 4,275,090 | 6/1981 | McComas | 427/34 |
| 4,313,760 | 2/1982 | Dardi et al. | 428/678 |
| 4,339,509 | 7/1982 | Dardi et al. | 428/680 |
| 4,404,263 | 9/1983 | Hodes et al. | 428/632 |
| 4,446,199 | 5/1984 | Gedwill et al. | 428/678 |

(List continued on next page.)

FOREIGN PATENT DOCUMENTS

| | | |
|---|---|---|
| 1131947 | 9/1982 | Canada . |
| 0157231 | 11/1985 | European Pat. Off. . |
| 1-188645 | 7/1989 | Japan . |
| 2095700 | 2/1982 | United Kingdom . |

OTHER PUBLICATIONS

Metals Handbook, Tenth Edition TA 459 M43, 1990, pp. 950–957.

"Databook", 1978, Metal Progress Mid–Jun. 1978, p. 106, (No Month).

"East, Handbook of Chemistry and Physics", 57th Ed, CRC Press Inc, QD 65 C4 1976–1977, pp. 116, 135, 175 (No Month).

Thin Solid Films, vol. 173, No. 1, Jun. 1, 1989, Lausanne, CH, pp. 99–107; B. Gudmundsson 'Yttrium Oxides in Vacuum–Plasma–Sprayed CoNiCrALY Coatings' p. 100, paragraph 2.3.

WO–A–8 706 273, Publication Date Oct. 22, 1987. Title: Coating to Protect Against Wear and Fretting Corrosion of, in Particular, Metal Mechanical Components Held Together by Frictional Adherence.

*Primary Examiner*—Ngoc-Yen Nguyen

*Attorney, Agent, or Firm*—Andrew C. Hess; David L. Narciso

[57] ABSTRACT

A coated superalloy component includes a substrate article formed of a superalloy and an adherent coating over the substrate. The coating is a nickel-base superalloy containing 0.3 volume percent or more of a dispersed oxide of yttrium, hafnium and/or a rare earth, and, preferably, grain boundary strengthening elements such as carbon, zirconium, and boron. The oxide dispersoids improve the performance of the coating in service, reducing the incidence failures due to thermal fatigue, oxidation, and corrosion damage. The dispersoid-containing coating may be formed by directly depositing the oxide-containing coating, or by depositing a metallic coating under conditions which permit the formation of such dispersoids during the deposition process.

9 Claims, 1 Drawing Sheet

U.S. PATENT DOCUMENTS

| | | | |
|---|---|---|---|
| 4,569,824 | 2/1986 | Duhl et al. | 148/404 |
| 4,717,435 | 1/1988 | Kawasaki et al. | 148/410 |
| 4,758,480 | 7/1988 | Hecht et al. | 428/680 |
| 4,764,225 | 8/1988 | Shankar et al. | 148/425 |
| 4,921,405 | 5/1990 | Wilson | 419/241 R |
| 4,961,818 | 10/1990 | Benn | 148/428 |
| 4,995,922 | 2/1991 | Jongenburger | 148/428 |
| 5,043,138 | 8/1991 | Darolia et al. | 428/614 |
| 5,141,821 | 8/1992 | Lugscheider et al. | 428/614 |
| 5,240,491 | 8/1993 | Budinger et al. | 75/255 |

FIG. 1
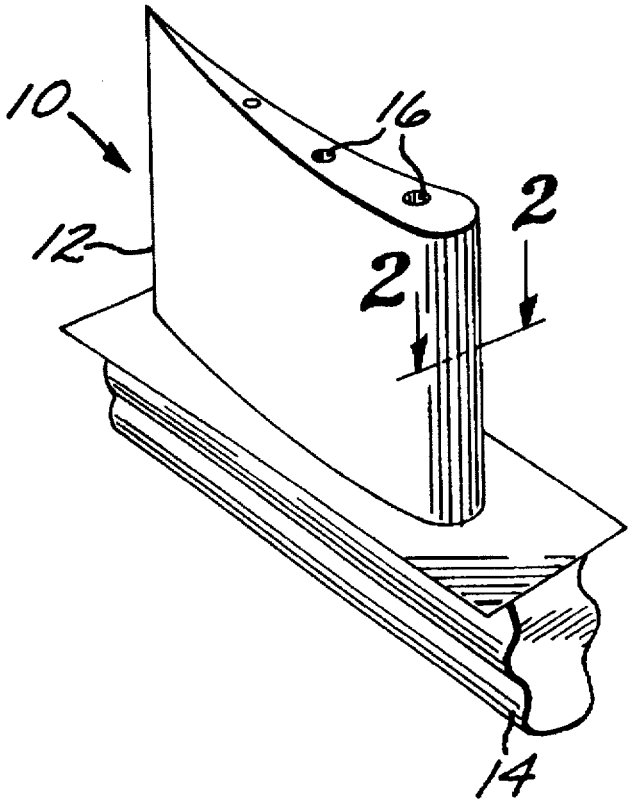
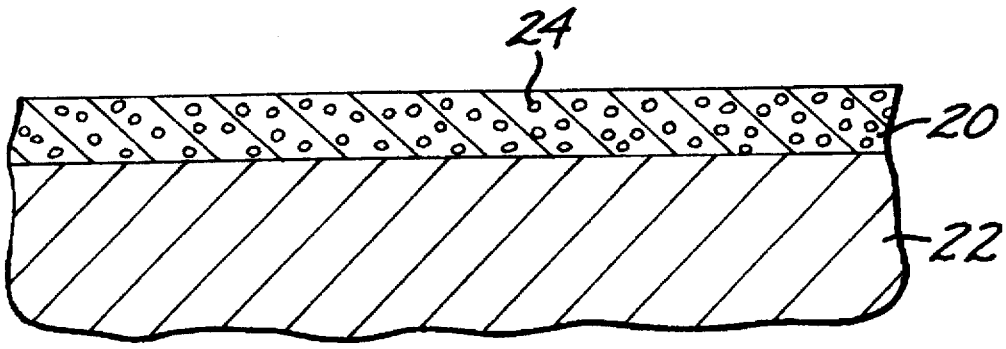
FIG. 2

SUPERALLOY COMPONENT WITH DISPERSION-CONTAINING PROTECTIVE COATING

This application is a Continuation of application Ser. No. 08/185,775 filed Jan. 24, 1994, which is a Continuation of application Ser. No. 07/956,515, filed Oct. 5, 1992 which is a continuation-in-part of application Ser. No. 07/756,947, filed Sep. 9, 1991, now abandoned.

This invention was made with Government support under Contract No. N-0019-80-C-0017 awarded by the Naval Air Propulsion Center. The Government of the United States has certain rights in this invention.

This application is related to commonly assigned application Ser. No. 07/756,953, filed concurrently with the parent application hereof, now U.S. Pat. No. 5,316,866, the disclosure of which is hereby incorporated by reference.

BACKGROUND OF THE INVENTION

This invention relates to the protection of superalloys to be used at elevated temperatures, and, more particularly, to superalloy articles protected by coatings.

One of the most demanding materials applications in current technology is found in the hot-stage components used in aircraft jet engines. The higher the operating temperature of an engine, the greater its efficiency, and the more power it can produce from each gallon of fuel. There is therefore an incentive to operate such engines at as high a temperature as possible. The primary limitation on the operating temperatures of a jet engine is the materials used in the hottest regions of the engine, such as gas turbine blades and vanes.

There has been much research to develop materials that can be used in high temperature engine applications. The currently most popular and successful of such materials are the nickel-base superalloys, which are alloys of nickel with additions of a number of other elements such as, for example, chromium, cobalt, aluminum, and tantalum. The compositions of these superalloys are carefully engineered to maintain their strength and other mechanical properties even during use at the high temperature of engine operation, which is in the neighborhood of 2000° F. or more.

The materials used in the jet engines must operate at high temperatures, but additionally are subjected to oxidative and corrosive conditions. Oxidation of materials such as nickel and many of its alloys is rapid at engine operating temperatures. The engine components are also subjected to corrosive attack by chemicals in the burned fuel, as well as ingested agents such as salt that might be drawn into the engine as it operates near an ocean. The materials that have the best mechanical properties at high temperatures often are not as resistant to oxidation and corrosion as other materials, and there is an ongoing search for materials that offer a compromise between the best mechanical properties and the best oxidation and corrosion resistance.

High operating temperatures can also be achieved by other techniques not related directly to the alloy compositions used in the components. For example, control of grain structures and use of single crystals can result in improved properties. Cooling passages may be provided in the components, and cooling air passed through them to lower their actual operating temperature.

In another approach which is the primary focus of the present invention, a thin protective metallic coating is deposited upon the component. The coating protects the substrate from oxidation and corrosion damage. The coating must be adherent to the superalloy substrate and must remain adherent through many cycles of heating to the operating temperature and then cooling back to a lower temperature when the engine is idling or turned off. Because materials of different compositions have different coefficients of thermal expansion, differential strains develop between the coating and the component.

To accommodate the strains imposed by the thermal cycling, the thin coatings have been made of materials that are relatively weak and ductile. Such a coating can plastically deform either in tension or compression to remain adherent to the surface of the substrate as the substrate is heated and cooled. Most coatings for nickel-base superalloys have been made of alloys of nickel, chromium, aluminum, and yttrium, which are termed NiCrAlY alloys, and nickel, cobalt, chromium, aluminum, and yttrium, which are termed NiCoCrAlY alloys. The term MCrAlX, where M represents nickel, cobalt, iron or some combination thereof and X represents yttrium, hafnium, tantalum, silicon or some combination thereof, is a widely used generic description for this type of alloy. While such alloys contain many of the same elements as the substrate materials, the proportions of those elements have been adjusted to enhance oxidation and corrosion resistance rather than mechanical properties. They therefore lack the strength to serve as the structural components themselves, but serve well as protective coatings.

There remains an ongoing need for improved metallic coating materials that can protect the substrates for extended periods of time, against oxidation and corrosion damage. The present invention fulfills this need, and further provides related advantages.

SUMMARY OF THE INVENTION

The present invention provides a class, and specific alloy compositions, of metallic coating materials useful in protecting high-temperature superalloys. The compositions are compositionally and structurally compatible with the superalloy substrates, protect against oxidation and corrosion damage, and remain adherent, crack-free, and protective for greater periods of time than prior metallic superalloy coatings. The coatings are formulated and applied by conventional techniques.

In accordance with the invention, a coated superalloy component comprises a substrate article formed of a superalloy and an adherent coating over the substrate. The coating is a nickel-base superalloy additionally containing at least 0.3 volume percent of dispersed particles of an oxide of yttrium, hafnium, a rare earth, or combinations thereof.

Throughout this discussion, the amount of dispersed particles is reported as volume percent; such amounts can be determined by quantitative metallography. It was found that the total volume of such particles is a preferred analytical method for characterizing the behavior of alloys of the present invention. The composition of the matrix material is reported as weight percent, which is the customary way to report compositions determined by conventional chemical analysis techniques. To reconcile these two methods of reporting, the term "balance nickel", as used herein, includes the particle-forming elements such as yttrium, hafnium and the rare earths. Also, the term includes impurities typically found in nickel-base alloys, which, by nature and amount, do not adversely affect the beneficial aspects of the present invention.

It is well known to provide yttrium, hafnium and/or rare earth elements in superalloys and superalloy coatings to improve their resistance to oxidation. It is thought that a film containing oxides of these elements, and aluminum if it is present in the superalloy, is formed on the surface of the substrate. However, these elements are present in small amounts or are provided in such a compositional and formation context that a high fraction of their oxide dispersoids is not formed. The approach of the present invention intentionally provides dispersoids of oxides of such elements distributed throughout the coating in such a way as to improve the properties of the coating.

The coatings of the invention represent a significant departure from conventional thinking in the metallic coating area. Heretofore, metallic superalloy coatings were made weak and ductile, to accommodate the strains imposed by the substrate as the component was repeatedly heated and cooled. The coating is deformed in complex planar strain conditions that are dictated by the deformation of the more massive substrate. The coating must deform plastically and/or in creep to a new set point during the temperature and load cycling of the engine, and a weak coating was deemed most desirable to operate under these constraints.

It was observed in the research underlying this invention that metallic coatings tend to fail in thermal fatigue, and that the weak coatings did not offer sufficient mechanical resistance to such fatigue failure. The present invention therefore provides an oxide-dispersion containing coating, a coated article, and a method for preparation thereof. The oxide-containing coating is more resistant to thermal fatigue damage than the NiCrAlY or NiCoCrAlY alloys conventionally used as metallic coating materials, without sacrificing oxidation and corrosion resistance.

The present invention provides an important advance in the art of superalloys, as well as a departure from the conventional thought in the field. The coating of the invention permits a controllable improvement to the properties of the coating through selection of the fraction of dispersoid, while retaining the chemical components that lead to oxidation and corrosion resistance. Other features and advantages of the invention will be apparent from the following more detailed description of the preferred embodiment, taken in conjunction with the accompanying drawings which illustrate, by way of example, the principles of the invention.

BRIEF DESCRIPTION OF THE DRAWINGS

FIG. 1 is a perspective view of a turbine blade having a metallic protective coating; and FIG. 2 is an enlarged sectional view of the turbine blade of FIG. 1, taken along lines 2—2.

DETAILED DESCRIPTION OF THE PREFERRED EMBODIMENT

The coating of the invention is preferably used with nickel-base superalloys, in applications such as a jet engine gas turbine blade 10 illustrated in FIG. 1, or a gas turbine vane which has a similar appearance in relevant respects. The blade 10 may be formed of any suitable superalloy such as Rene80, a well known nickel-base superalloy which has a nominal composition, in weight percent, of 14 percent chromium, 9.5 percent cobalt, 5 percent titanium, 4 percent tungsten, 4 percent molybdenum, 3 percent aluminum, 0.17 percent carbon, 0.06 percent zirconium, 0.015 percent boron, and the balance nickel. Another example is a more advanced nickel-base superalloy such as ReneN4, having a composition, in weight percent, of 7.5 cobalt, 9.0 chromium, 3.7 aluminum, 4.2 titanium, 1.5 percent molybdenum, 4.0 percent tantalum, 6.0 percent tungsten, 0.5 percent niobium, and balance nickel. These substrate superalloys are presented as examples, and the coatings are not limited for use with these substrates.

Such a blade 10 includes an airfoil section 12 against which hot combustion gases are directed when the engine operates, and whose surface is subjected to severe oxidation and corrosion attack during service. If the surface of the airfoil section 12 is not protected against oxidation and corrosion in some fashion, it will normally last at most only a few cycles of operation. The airfoil section 12 is anchored to a turbine disk (not shown) through a root section 14. In some cases, cooling passages 16 are present in the airfoil section 12, through which cool bleed air is forced to remove heat from the blade 10. The blade 10 is normally prepared by a casting and solidification procedure well known to those skilled in the art, such as investment casting or, more preferably, directional solidification or single crystal growth.

According to the present invention, the airfoil section 12 is protected by a metallic protective coating 20, as illustrated in detail in FIG. 2, which depicts an enlargement of a section through the surface portion of the blade 10. The nickel-base superalloy of the blade 10 (or of a gas turbine vane or other superalloy component) forms a substrate 22 upon which and over which the coating 20 is deposited. The coating 20 contains at least about 0.3 percent by volume of a dispersion of oxide particles 24 formed by the oxidation of yttrium, hafnium and/or rare earth elements. These particles may be equiaxed or roughly spherical in shape, but they could have an elongated or pate-like shape. (In FIG. 2, both the volume fraction of the dispersoid and its size are exaggerated for purposes of clarity of illustration.)

The coating may be applied by low pressure plasma spraying (LPPS) or air plasma spraying (APS) a layer of the coating composition onto the surface of the component. The techniques of LPPS and APS are known to those skilled in the art. However, the coatings of the present invention are advantageously applied in an atmosphere having a partial pressure of oxygen greater than about 0.0001 atmosphere. In the preferred LPPS plasma spraying generally, powders having a desired net composition are melted (at least partially) in a plasma and propelled against the substrate, where they solidify to form the coating. The powders are desirably uniform in composition, but plasma spray coating can also be accomplished using particles of different compositions having a net desired composition, which intermix while molten. The LPPS operation is carried out in a low pressure environment of near-vacuum, or in inert gas at a pressure lower than about 0.1 atmosphere, but one having a small partial pressure of oxygen. In APS, the partial pressure of oxygen is about 0.2 atmosphere. The thickness of the coating is typically from about 0.001 to about 0.010 inch, most preferably about 0.004 inch.

In accordance with one aspect of the invention, a method for preparing a coated superalloy component comprises the steps of providing a substrate article formed of a nickel-base superalloy; and applying an adherent coating to the article by a thermal spray process, the coating being a nickel-base superalloy additionally containing at least 0.3 volume percent of dispersed oxide particles formed of an element selected from the group consisting of yttrium, hafnium and the rare earths. The superalloy of the coating can be any coating designed for protection of the substrate against oxidation and corrosion. The oxides can be simple oxides or complex oxides containing one or more of the elements yttrium, hafnium and the rare earths. In this method, the oxide dispersoids may be present in the plasma-sprayed powders prior to the spraying process, or they may be formed as thin oxide shells on the surfaces of powder particles during the spraying process while the particles are being propelled toward the substrate; the shells break up into dispersoids as the particles impinge upon the substrate. Alternatively, powder particles already processed to contain dispersoids, such as by the well-known mechanical alloying process, may be employed in the thermal spray process After application to the substrate, the coating must contain at least 0.3 volume percent of the oxide dispersoids, or the individual dispersoid particles will be too widely spaced to have a significant effect on reduction of cracking of the coating during thermal fatigue cycling. Larger amounts are acceptable, as long as they do not lead to brittleness of the coating. As a practical limit, up to 2.0 volume percent of the dispersoids is acceptable, although 0.5 to 1.0 volume percent of the dispersoids is preferred.

As used herein, the term "the rare earths" comprehends, those elements of the lanthanide series of the periodic table, atomic numbers 57–71 inclusive. These elements include lanthanum, cerium, praseodymium, neodymium, prometheum, samarium, curopium, gadolinium, terbium, dysprosium, holmium, erbium, thulium, ytterbium, and lutetium. Although yttrium, atomic number 39, and hafnium, atomic number 72, are sometimes grouped together with the rare earths, they are separately identified herein, and not included among the rare earths.

In a preferred embodiment of the invention, a conventional NiCoCrAlY coating material was modified by adding sufficient yttrium to form 0.5 volume percent yttrium oxide and also alloying elements to strengthen the grain boundary regions of the coating. A standard NiCoCrAlY coating alloy has a composition, in weight percent, of about 20–23 percent cobalt, 18 percent chromium, 12.5 percent aluminum, 0.3 percent yttrium, and balance nickel. A satisfactory coating alloy is obtained by leaving the major alloying elements substantially as they are, and adding carbon, boron, or zirconium to strengthen the grain boundaries of the coating, and sufficient yttrium to produce a dispersion of at least 0.5 volume percent yttrium oxide ($Y_2O_3$) particles throughout the coating. The grain boundary strengthener is preferably up to about 0.07 weight percent carbon, up to about 0.030 weight percent zirconium, and up to about 0.030 percent boron, or combinations thereof. The preferred minimum contents are about 0.01 percent carbon, about 0.005 percent zircontum, and about 0.005 percent boron. Amounts below those indicated do not strengthen the grain boundaries to any appreciable degree, which may lead to premature failure of the coating due to grain boundary creep. Amounts above the maximums can lead to grain boundary embrittlement, also a cause of premature failure.

In accordance with this aspect of the invention, a coated superalloy component comprises a substrate article formed of a superalloy, and an adherent coating over the substrate, the coating being a nickel-base superalloy containing at least one gamma phase grain boundary strengthener selected from the group consisting of up to about 0.07 percent carbon, up to about 0.030 percent zirconium, and up to about 0.030 percent boron, and additionally containing at least 0.3 volume percent of dispersed oxide particles formed of an element selected from the group consisting of yttrium, hafnium, the rare earths, and combinations thereof. The adherent coating is applied directly to the substrate article, there being no intermediate coatings between the adherent coating and the substrate, as is often found in the art. The adherent coating has a first surface and a second surface, the first surface being in contact with the substrate and the second surface being in contact with the flow of hot gases of the gas turbine engine environment.

The presently most preferred coating according to the invention has a nominal metallic matrix composition, in weight percent, of 20 percent cobalt, 18 percent chromium, 12 percent aluminum, 0.05 percent carbon, 0.015 percent boron, 0.015 percent zirconium, 1.0 percent silicon and the balance nickel (which includes 0.3 percent yttrium present in the metallic form prior to the deposition process). About 0.5 percent by volume of yttrium oxide particulate material was formed during the deposition process. This coating may be applied by any type of plasma spraying, but preferably by LPPS, which was employed in the examples described herein. The presence of the oxide particulate distinguishes the coatings of the present invention from known coatings and superalloys which have otherwise similar chemical compositions, as reported in weight percent, but no oxide dispersoid particles.

The coating of the preceding paragraph was applied to a simulated gas turbine blade made of the ReneN4 superalloy discussed previously. These simulated blades were comparatively tested against identical simulated blades of the same ReneN4 superalloy, except having a CODEP coating prepared by the pack-diffusion process disclosed in U.S. Pat. No. 3,540,878. In a burner rig thermal fatigue test, the coated blades were cycled between 970° F. and 1800° F. for 5000 cycles, and inspected. The blades coated with the dispersion-containing coating exhibited approximately the same number of cracks as for the CODEP coated blades, but the severity of the cracks was much less for the dispersion-containing coatings.

In an accelerated burner rig oxidation test at 2075° F. and Mach 1 gas velocity, a set of test specimens with the dispersion-containing coating had an average lifetime of 585 hours, as compared with 125 hours for identical CODEP-coated specimens. In a hot corrosion test at 1700° F. and a 5 ppm (parts per million) salt environment, the dispersion-containing coating had an average life of at least 1600 hours (at which time the test was discontinued), compared to only 550 hours for the CODEP-coated blade.

Thus, the dispersion-containing coating of the invention produces improved results in simulated operating environments as compared with state-of-the-art CODEP coatings.

The coated superalloy components may be heat treated to improve the properties of the substrate, using heat treatments appropriate therefor. For example, a typical heat treatment cycle for a previously homogenized substrate article of Rene80, which is coated, then heat treated, is nominally as follows: 4 hours at 2000° F., cooled to below 1200° F., 2 hours at 1925° F., cooled to below 1200° F., and 4 hours at 1525° F. Where the alloy of the coating is amenable to gamma-prime strengthening, such a heat treatment may also increase the strength of the coating. This effect is additive to the strengthening achieved through the oxide dispersion of the present invention. The oxide dispersion of the present invention is not affected by heat treatments of this type.

Coatings of the present invention are typically stronger than conventional NiCoCrAlY coatings. For example, the rupture life of a conventional NiCoCrAlY coating, tested at 1600° F. and 3,000 pounds per square inch stress, is about 13 hours. As deposited, the coating described above has a rupture life under the same test conditions of about 23 hours. After heat treating the coating 2 hours at 2310° F., the rupture life was increased to 506 hours. The increased strength is believed to contribute to the observed reduction in severity of cracks in the coating.

Thus, the present approach provides an advancement in the protection of superalloy substrates, and more particularly nickel-base superalloy substrates by metallic protective coatings. Although the present invention has been described in connection with specific examples and embodiments, it will be understood by those skilled in the arts involved, that the present invention is capable of modification without departing from its spirit and scope as represented by the appended claims.

What is claimed is:

1. A coated superalloy component, comprising:

a substrate article formed of a superalloy; and an adherent environmentally-resistant coating applied directly to the substrate, the coating being a nickel-base superalloy with a nominal composition consisting essentially of, in weight percent, about 20 to 23 percent cobalt, 18 percent chromium, 12.5 percent aluminum, 0.3 percent yttrium, between about 0.01 and 0.07 percent carbon, between about 0.005 and 0.030 percent zirconium, and between about 0.005 and 0.030 percent boron, the balance nickel, and additionally containing dispersoids of from 0.3 to 2.0 volume percent of dispersed oxide particles formed of an element selected from the group consisting of yttrium, hafnium, rare earth metals, and combinations thereof.

2. The component of claim 1, wherein the oxide particles are yttrium oxide.

3. The component of claim 1, wherein oxide particles of a plurality of oxides of the elements selected from the group consisting of yttrium, hafnium and rare earths and combinations thereof are present.

4. The component of claim 1, wherein the component is a turbine vane.

5. The component of claim 1, wherein the component is a turbine blade.

6. The component of claim 1, wherein the dispersed oxide particles are present in the coating immediately upon deposition thereof on the substrate article, prior to any subsequent thermal treatment of the component.

7. The component of claim 1, wherein the coating is applied to the substrate by a plasma spray process conducted under a partial pressure of oxygen of at least 0.0001 atmosphere, thereby forming oxide particles in the coating during the plasma spray process.

8. The component of claim 1, wherein the coating contains from 0.5 to 1.0 volume percent of dispersed particles.

9. A coated superalloy component, comprising:

a substrate article formed of a superalloy; and an adherent environmentally-resistant coating with a nominal composition consisting of, in weight percent, 20 percent cobalt, 18 percent chromium, 12 percent aluminum, 1.0 percent silicon, 0.05 percent carbon, 0.015 percent zirconium, and 0.015 percent boron, the balance nickel and yttrium in metallic form, and additionally containing dispersoids of from 0.3 to 2.0 volume percent of dispersed oxide particles formed of an element selected from the group consisting of yttrium, hafnium, rare earth metals, and combinations thereof.

* * * * *